US007781653B2

(12) United States Patent
Reynolds

(10) Patent No.: US 7,781,653 B2
(45) Date of Patent: Aug. 24, 2010

(54) STRINGED INSTRUMENT USING FLOWING LIQUID

(76) Inventor: Matthew Damon Reynolds, 1427 Pinecroft Dr., Houston, TX (US) 77498

( * ) Notice: Subject to any disclaimer, the term of this patent is extended or adjusted under 35 U.S.C. 154(b) by 44 days.

(21) Appl. No.: 12/231,255

(22) Filed: Aug. 30, 2008

(65) Prior Publication Data

US 2010/0050849 A1 Mar. 4, 2010

(51) Int. Cl.
*G10D 1/08* (2006.01)

(52) U.S. Cl. ..... 84/267; 84/410

(58) Field of Classification Search ..... 84/267, 84/410

See application file for complete search history.

(56) References Cited

U.S. PATENT DOCUMENTS

| | | | | |
|---|---|---|---|---|
| 4,024,409 | A | 5/1977 | Payne | |
| 6,452,080 | B1 | 9/2002 | Coonce | |
| 7,009,098 | B2 * | 3/2006 | Carter | 84/410 |
| 7,224,077 | B2 | 5/2007 | Allen | |
| 7,381,881 | B1 * | 6/2008 | Sapp | 84/622 |
| 7,493,759 | B2 | 2/2009 | Bernitsas | |

FOREIGN PATENT DOCUMENTS

JP 2004000320966 5/2006

OTHER PUBLICATIONS

Gordon Monahan, Aquaeolian Whirlpool, Web Page www.gordonmonahan.com/pages.aquaeolian_whirlpool.html 1st Exhibition: New York Hall of Science, Queens, N.Y. 1990.

M.M. Sevik, Buffeting Excitation of Structures by Fluid Flow, Journal, Acoustical Society of America. Apr. 1976, vol. 59, Issue S1 pp. s19-s19, Melville, N.Y.

Sevik, M.M.; Buffeting excitation of structures by fluid flow J. Acoust. Soc. Am. vol. 59, Issue S1, pp. S19-S19 (Apr. 1976).

Monahan, Gordon; Aquaeolian Whirlpool; http://www.gordonmonahan.com/pages/aquaeolian_whrlpool.html 1st exhibition: New York Hall of Science, Queens, N.Y, 1990.

* cited by examiner

*Primary Examiner*—Jianchun Qin

(57) ABSTRACT

The present invention is a stringed instrument that comprises a circulating element that transmits a stream of liquid through a conduit at a flow rate of 0.92 meters per second to 1.58 meters per second. A string that is displaceable along the stream of liquid produces vibrations caused by the interaction between the stream of liquid and the string. A device positioned proximate the string registers vibrations emanating from the string. Interaction between said stream of liquid and said at least one string generate vibrations with frequencies ranging from 220 Hz to 1318 Hz.

19 Claims, 6 Drawing Sheets

STRINGED INSTRUMENT USING FLOWING LIQUID

FIELD OF THE INVENTION

This invention relates generally to stringed musical instruments, particularly instruments that produce unorthodox sounds that are produced by vibration of the strings contained in the instrument.

BACKGROUND OF THE INVENTION

Traditional stringed musical instruments emit vibrations that are produced by striking or strumming taut strings. Guitars, violins, harps, lutes and an assortment of other stringed instruments utilize the manual stroking or strumming of strings with a hand, pick or bow to impart vibrations that are amplified to produce music. Stringed musical instruments vary the placement of the strings, gauge of the strings, and the orientation of the strings to impart unique sounds. There is always a desire to explore the creative bounds of music, and to find new and inventive ways to produce music.

The pursuit of unique and alternative music has resulted in aeolian harps and similar instruments that utilize the concept of imparting mechanical energy to strings to produce vibration and sounds. This is similar to traditional stringed musical instruments, but the mechanical energy is derived from wind or another natural source. Aeolian harps produce sound that is random, depending on the strength of the wind passing over the strings, and can range from a barely audible hum to a loud scream. Aeolian harps were popular in the Romantic period and are often located in bell towers and hilltops to capitalize on ample wind supply at those locations.

Modern artist have explored the bounds of the aeolian harp concept by using water to impart mechanical energy, however, all these attempts are limited by the inability to derive a way to control the mechanical energy imparted on the strings. Thus previous attempts have fallen short of producing an instrument that is capable of being controlled by a user to produce music rather than random sounds that are chaotically produced by natural elements striking the strings.

The present invention is directed to overcoming these and other deficiencies in the art.

SUMMARY OF THE INVENTION

The present invention is a stringed instrument that uses a pump mechanism to flow liquid over one or more strings to produce unorthodox music. The liquid flow rate is controlled by the pump to generate a flow rate to produce sounds that are audible and controllable. The strings can be manipulated by increasing the tension and position in the liquid stream to produce a range of sounds.

In one aspect, the present invention is a stringed instrument that comprises a circulating element that transmits a stream of liquid through a conduit at a flow rate of 0.92 meters per second to 1.58 meters per second. A string that is displaceable along the stream of liquid produces vibrations caused by the interaction between the stream of liquid and the string. A device positioned proximate the string registers vibrations emanating from the string. Interaction between the stream of liquid and the string generates vibrations with frequencies ranging from 220 Hz to 1318 Hz.

In some aspects, the conduit and circulating element are arranged in a loop to circulate liquid, and a receptacle is positioned between the conduit and the string.

In some aspects, the stream of liquid is flowing at a constant rate, and the instrument further comprises a grid positioned adjacent the string. The grid is ruled into small squares of equal size and each position on the grid coordinates with a single frequency that is emitted upon interaction between the string and the stream of liquid.

The present invention can include one more valves that are used to control the flow rate of the stream of liquid.

In some aspects, the invention comprises a frame that the string is mounted to and the frame is displaceable along the stream of liquid.

In some aspects, the circulating element is a positive displacement pump or a rotodynamic pump. The stringed instrument can include a tension adjustment element on the frame that enables the string to be tightened and loosened to change frequencies capable of being produced by the string. The stringed instrument can include a fretboard on the frame.

In some aspects, the invention has a guide that the frame is slidingly and/or rotatably engaged, and the guide positions the frame proximate the stream of liquid.

In other aspects, the present invention is a stringed instrument that comprises a string attached to a frame, and a conduit that emits a stream of liquid, and the string is displaceable along the stream of liquid. A device is positioned proximate the string that registers vibrations emitted from the string.

In some aspects, an amplifier is used to increases the amplitude of the vibrations registered by the registering device.

The invention can include a guide that the frame is rotatably and slidingly engaged, and the guide enables the frame to be positioned proximate the stream of liquid.

In some aspects, the invention comprises a circulating element connected to the conduit. A receptacle is connected to the circulating element, and the receptacle, circulating element and conduit form a loop to collect and circulate liquid toward the string. The circulating element can be a positive displacement pump.

These and other objects, features and advantages of the present invention will become readily apparent to those having ordinary skill in the art upon reading the following detailed description of the invention in view of the several drawings of the invention.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

The present invention relates to string instrument 10 utilizing a liquid circulation element 12 that directs a stream of liquid 24 at one or more strings 34 to generate vibrations that are registered by the instrument. The following written description describes the present invention utilizing the figures that are attached. Like figure numbers on different drawings identify identical structural elements of the invention. Dashed lines in the figures demonstrate items that are internal features that would otherwise be obscured by solid structures in the invention. The figures and written description disclose the invention that is presently considered the preferred embodiments, and it should be understood that the invention is not limited to only the disclosed embodiments.

Figure 1:
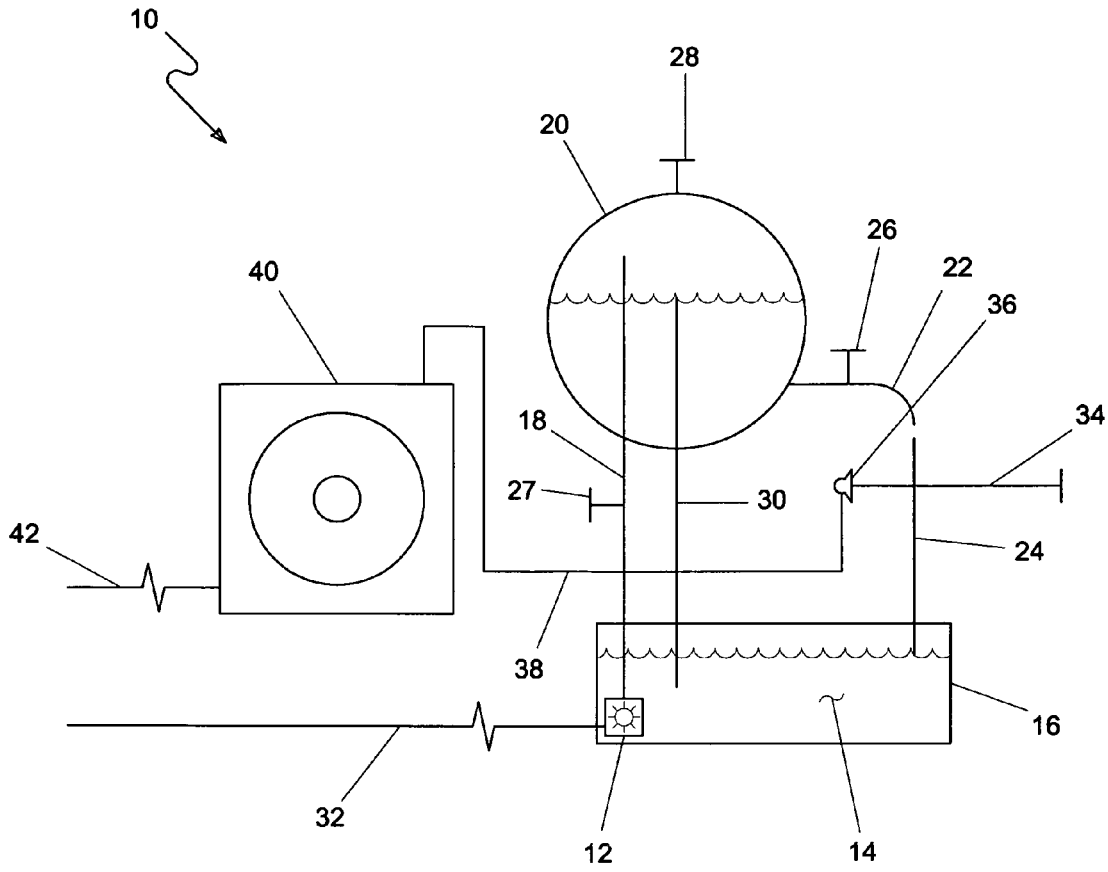
FIG. 1 is a schematic diagram of the stringed instrument of the present invention.

FIG. 1 is a schematic of instrument 10 with a circulating element 12 capable of transmitting liquid 14 from first receptacle 16 through conduit 18 to second receptacle 20. Liquid 14 is generally water, however, any other liquid, including but not limited to water with additives, gels, oils, and any other liquid of varying viscosity.

From second receptacle 20 liquid 14 is transmitted through conduit 22 and emitted as a stream of liquid 24 that is collected in first receptacle 16. It is preferred that the stream of liquid 24 be a laminar flow, sometimes known as streamline flow, where liquid flows in parallel layers, with no disruption between the layers. It is beneficial that stream of liquid 24 be free of any air, as air can create interruptions in the stream that can affect the vibrations and sounds produced by instrument 10. The present invention utilizes distinct isolated flow fields of water on strings to enable the playing of notes, as opposed to random noises and sounds.

Therefore, instrument 10 is preferred to provide a smooth water flow without air and with a range of moving water useful to the user of instrument 10. The velocity of the water must be considered. Water traveling too fast will not be effective in vibrating the string. Circulating element 12 transmits water to first receptacle 20 so that liquid 14 egresses from conduit 22 at a rate as near as possible to 0 feet per second. This will produce an optimum flow rate of liquid 14 in stream 24 ranging from 0.92 meters per second to 1.58 meters per second.

Circulating element 12 is a pump that is capable of transmitting liquid through a conduit to produce stream of liquid 24 at a flow rate desired by a user of instrument 10. In the embodiment shown circulating element 12, conduits 18 and 22, and first and second receptacles 16 and 20 are arranged in a loop that circulates liquid 14. When the liquid 14 reaches first receptacle 16 it is sent through conduit 18 to second receptacle 20 to be emitted again through conduit 22. In other embodiments, conduits 18 and 22 can be joined and receptacle 20 can be eliminated, and liquid 14 can then be emitted from conduit 22 at a rate to produce stream of liquid 24 desired by a user. Conduit as used in this description refers to any structure capable of conducting liquid from one point to another, such as a tube. The shape and flexibility of the conduits used in instrument 10 can be adapted to generate the particular flow rate, volume, and shape of stream of liquid 24 desired by the user.

In other embodiments, receptacle 20 can be open or closed, where the closed version could have a pressure relief valve 28. Overflow conduit 30 can be positioned between first receptacle 14 and second receptacle 20, to connect those receptacles, to facilitate the release of excess liquid 14 from second receptacle 20 to first receptacle 16. Top of conduit 30 is positioned in second receptacle 20 at a level sufficient to maintain a stream of liquid 24 that can approximate the optimal flow rate desired by the user.

Circulating element 12 is preferably a positive displacement pump that is powered by electrical power supply 32, however other pump options include a rotodynamic pump, or other pumps known to one skilled in the art to be capable of pumping liquid.

Liquid 14 is shown in FIG. 1 to fall from conduit 22 into first receptacle 16, however, in other embodiments that are not shown it is possible to emit liquid 14 at any other angle from conduit 22. Falling liquid does impart a unique quality to instrument 10 that has not been explored in the past. Free falling liquid from conduit 22 enable stream of liquid 24 to have the properties necessary to produce vibrations and/or sounds that can be arrange into music. Furthermore, FIG. 1 demonstrates an embodiment of the present invention wherein a single conduit 22 emits stream of liquid 24, however, multiple conduits can also be used to emit more than one stream of liquid, or single conduit 22 can also emit more than one stream of liquid 24.

Depending on the volume of liquid that can be transmitted by circulating element 12, the level of liquid in second receptacle 20 can increase the pressure and/or flow rate of liquid 14 exiting from conduit 22. Flow rate control can affect the quality, frequency, and wavelength of vibrations, and the inherent sounds from those vibrations, produced by instrument 10. Control of liquid 14 from conduit 22 can be achieved using a valve 26 that can be adjusted to change the flow rate of stream of liquid 24. Valve 26 can be used to adjust stream of liquid 24 to achieve a desired flow rate. Other valves such as valve 27 on conduit 18 can be included at other positions along the liquid circulation loop to adjust the flow rate and volume of the liquid.

String 34 is displaceable along stream of liquid 24 between conduit 22 and receptacle 16. The length of stream of liquid 24 is dependent on the position of conduit 22 relative to receptacle 16. Conduit 22 and receptacle 16 define the extremes of the path taken by stream of liquid 24. In the preferred embodiment, receptacle 16 is used to recapture liquid 14 transmitted in instrument 10, but in some instances receptacle 16 may not be used and liquid 14 is free to travel until it meets a surface or item the disrupts the stream of liquid. In such instances, stream of liquid 24 is defined by the distance between conduit 22 and the item or surface that disrupts stream of liquid 24.

The interaction of string 34 with stream of liquid 24 imparts mechanical energy to string 34 that causes string 34 to vibrate and produces sound waves of various frequencies. Displacement of string 34 at different positions along stream of liquid 24, as string 34 interacts with stream of liquid 24, produces vibrations that change in frequency and wavelength. Vibrations as used in this description refer to the movement of strings 34 due to the interaction with liquid 14 upon the string. As stream of liquid 24 flows over and around string 34, vortices are created on the downstream side of string 34. Vibrations are caused by both the initial contact between stream of liquid 24 and string 34 and vortices produced by pressure fluctuations that create vibrations on the downstream side of string 34. As the vortices break away from string 34 they generate vibrations that can dramatically excite string 34. Vibrations generated by vortices created by interaction between string 34 and the laminar flow of liquid 14 (stream of liquid 24) are referred to as vortex induced vibrations (VIV). Throughout this description vibration(s)

refers to any mechanical movement of string 34 by stream of liquid 24 by either direct contact on the upstream side of string 34 or by VIV.

Figure 6:
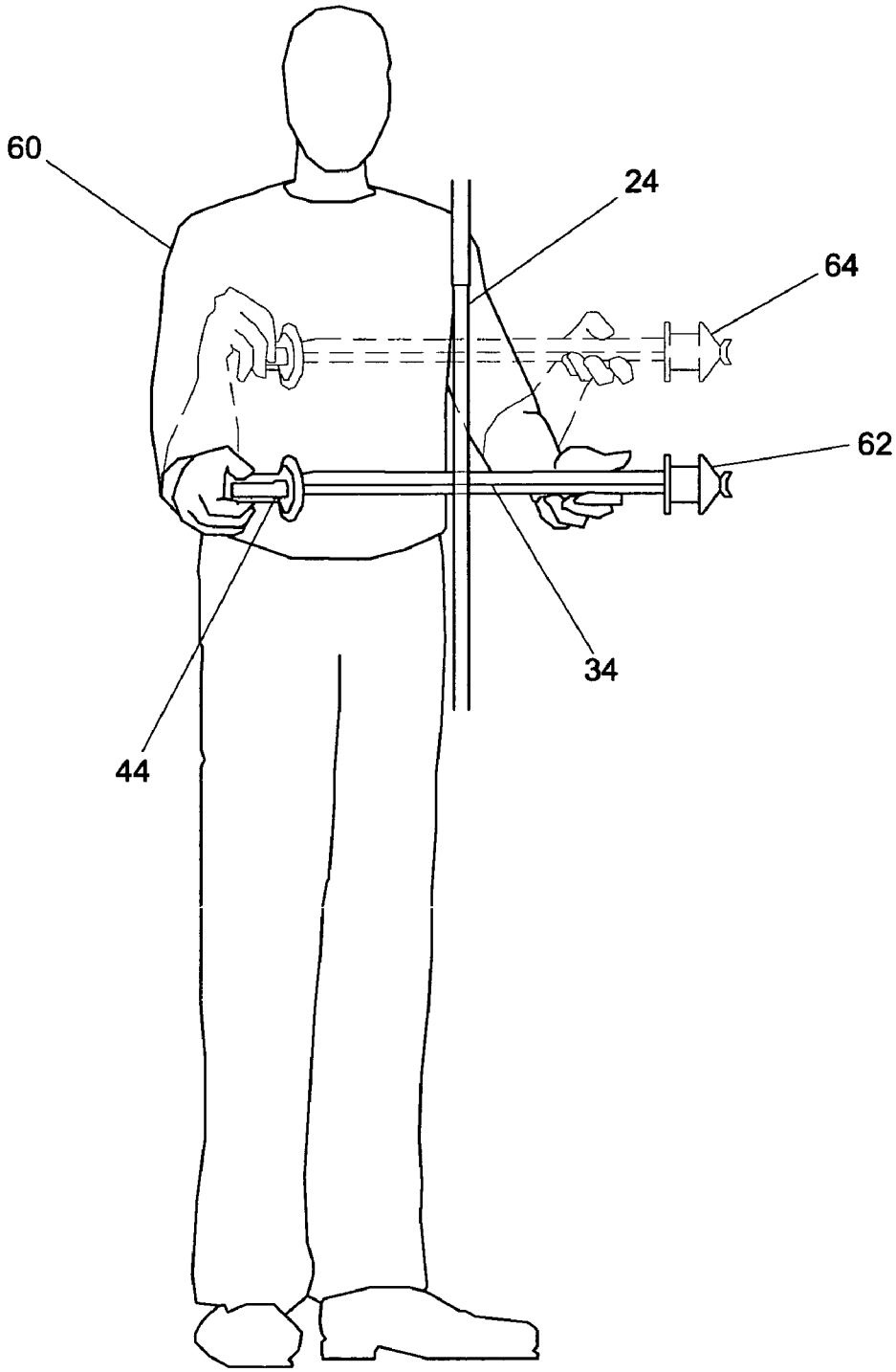
FIG. 6 shows a user demonstrating the movement of a frame and string arrangement within a stream of liquid.

String 34 is displaceable perpendicularly along stream of liquid 24 as shown in FIGS. 1 and 6, or the displacement of string 34 can be at a variety of angles relative within stream of liquid 24. In FIG. 6, you will also see user 60 moving string 34 from one position 62 to another position 64 within stream of liquid 24. Each position of string 34 in stream of liquid 24 changes the vibration, to generate a unique vibration for each position within stream of liquid 24. To clarify, positions of string 34 include the location of string 34 along the length of stream of liquid 24, the location of string 34 relative to the center of stream of liquid 24, as well as the angle that string 34 is held within stream of liquid 24.

Vibrations emanating from string 34 are registered by pickup 36, which is positioned proximate string or strings 34. Vibrations registered by pickup 36 are transmitted by transmission line 38 to an amplifying device 40 which is powered by power supply 42. Alternatively, vibrations can be captured and recorded, without amplification. Pickup 36 is generally any device capable of registering or capturing sound or vibrations, which includes, but is not limited to a microphone, stethoscope, magnetic pickup, piezoelectric pickup, divided pickup, or optical pickups, or any other device known to one skilled in the art. Optical pickups work by sensing the interruption of a light beam by the string. The light source is usually a LED, and the detector is a photodiode or phototransistor.

If metallic strings 34 are used, a magnetic pickup device can be used that acts as a transducer that captures mechanical vibrations and converts them to an electrical signal. No matter the vibration registering device the mechanical energy from the vibrating strings 34 can be captured (i.e., registered) and amplified and/or recorded.

Figure 2:
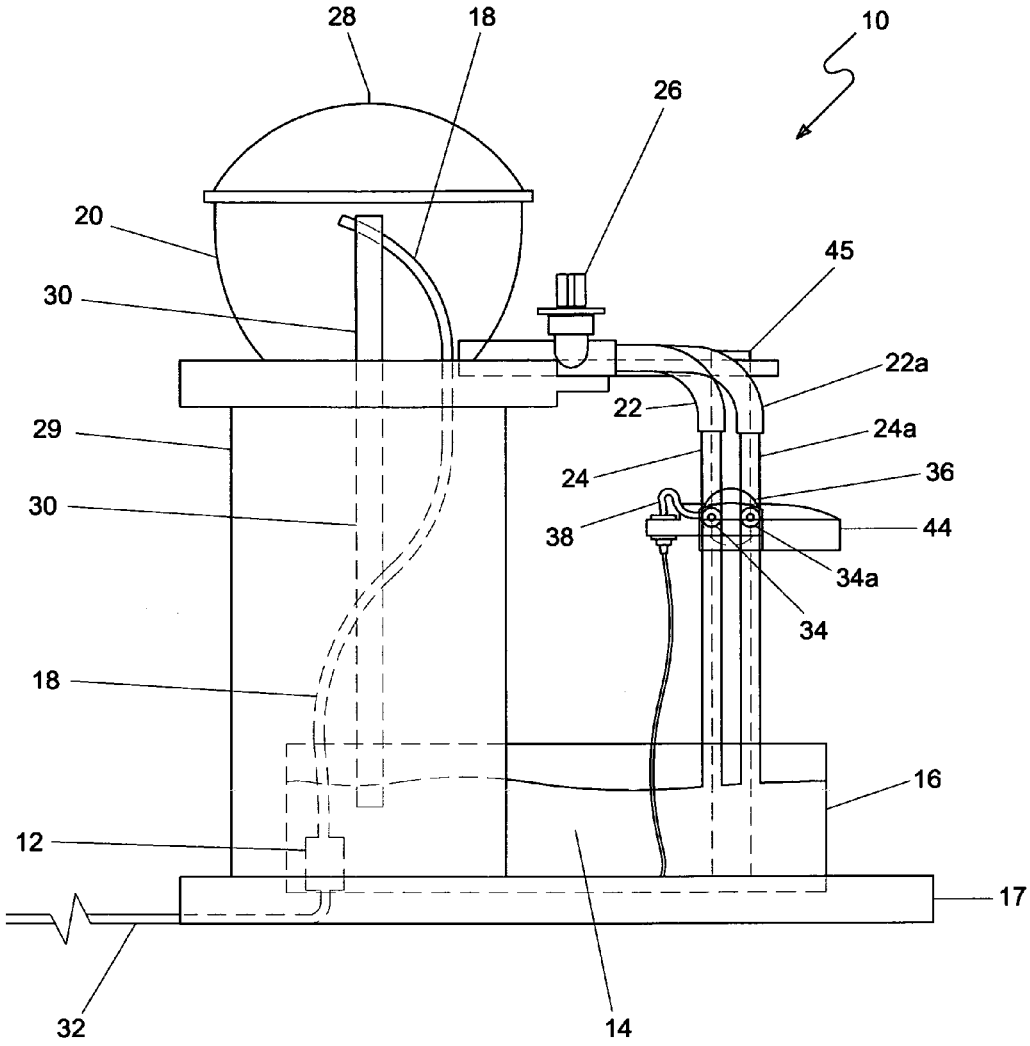
FIG. 2 is a side view of one embodiment of the stringed instrument of the present invention showing multiple streams of liquid.

FIG. 2 is a side view of one embodiment of instrument 10 showing multiple streams of liquid, designated as 24 and 24*a*, flowing from conduit 22 and 22*a*. As noted earlier, multiple conduits 22 can implemented to generate more than one stream of liquid. Conduit 22*a* can have a valve similar to valve 26 to adjust fluid flow. Instrument 10 is shown in FIG. 2 with housing 29 wherein conduits 18 and 30 reside. Housing 29 is also shown supporting receptacle 20, and secured to base 17.

In FIG. 2, string 34 is shown mounted upon frame 44. In the embodiment shown in FIG. 2 two strings 34 and 34*a* are mounted upon frame 44. In some embodiments, frame 44 can support multiple strings. As noted, vibrations emanating from strings 34 and 34*a* are registered by pickup 36. In some aspects, a dedicated pickup 36 is supplied for each string 34. String 34 can be composed of a variety of materials, which include, but are not limited to nylon (lightweight fishing line works especially well), horse hair, metal, flourocarbon strings or other substances known by those skilled in the art. Just as the material for the string can vary, so to can the gauge of strings 34 vary.

Figure 3:
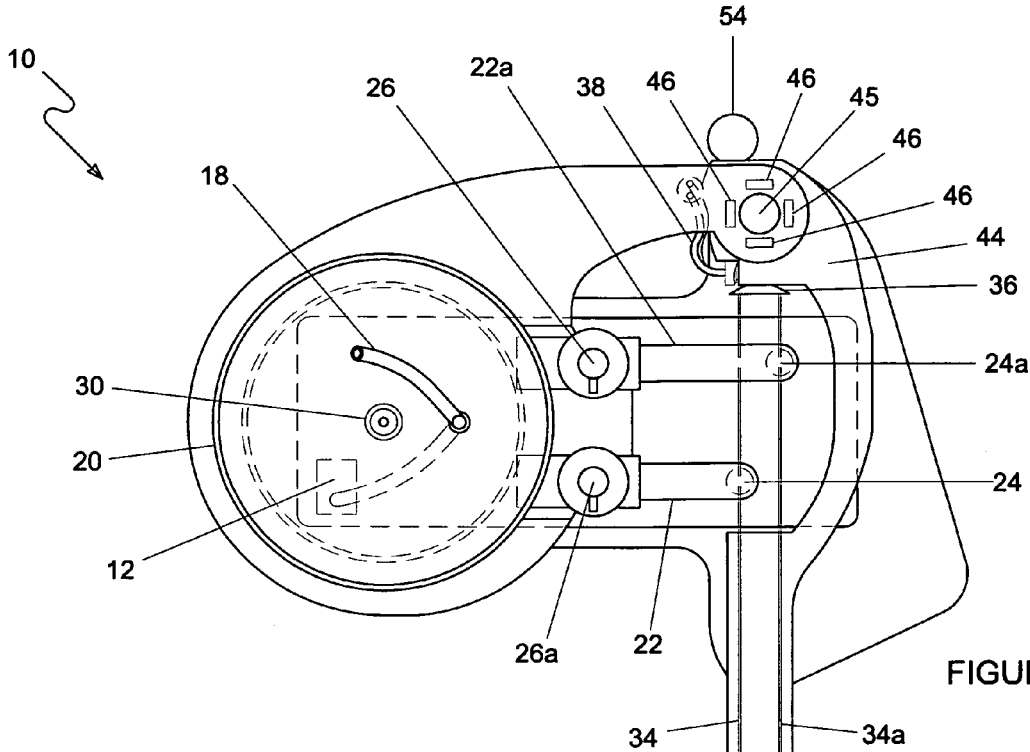
FIG. 3 is a top view of the stringed instrument of the present invention.

FIG. 3 is a top view of instrument 10 shown in FIG. 2 highlighting an alternative arrangement which mounts frame 44 on guide 45. Frame 44 is shown slidingly engaged with guide 45 which enables frame 44 and strings 34 and 34*a* to slide perpendicularly to streams of water 24 and 24*a*. It also has been observed that it would be beneficial to engage frame 44 with guide 45 in a manner that enables frame 44 to rotate about guide 45 or about streams of liquid 24. Therefore, frame 44 and strings 34 can be either rotatably or slidingly engaged with guide 45, or frame 44 and strings 34 can be both rotatably and slidingly engaged with guide 45.

To facilitate the smooth sliding of frame 44 on guide 45, sliders 46 can be housed in frame 44 to reduce friction between guide 45 and frame 44 as frame 44 is moved laterally along guide 45. Guide 45 is shown as a rod that slides through an aperture in frame 44 as shown in FIG. 3. Alternatively, guide 45 can take on other equivalent forms in which frame 44 is enabled to slide freely in a perpendicular fashion relative to streams of liquid 24. Sliders 46 can be various friction relieving mechanisms including, but not limited to ball bearings, wheels and other equivalent devices. This top view also demonstrates the dual conduits 22 and 22*a* with dual valves 26 and 26*a*.

Figure 4:
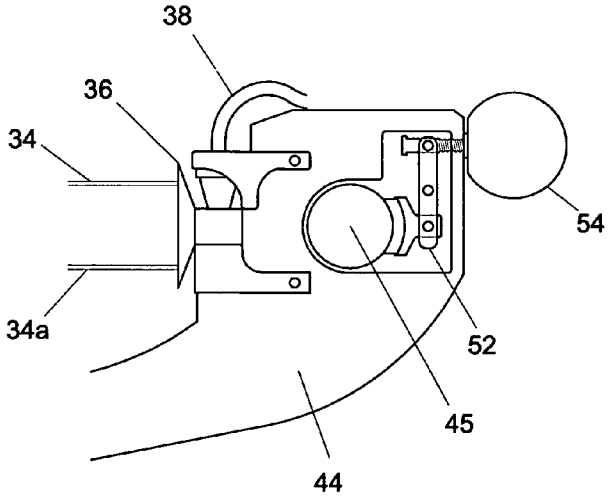
FIG. 4 is an enlarged partial view of the stringed instrument shown in FIG. 3.

FIG. 4 is an enlarged partial view of the interaction of frame 44 and guide 45 shown in FIG. 3. This enlarged view provides a vantage point to observe locking mechanism 52 that enables the temporary locking of frame 44 to guide 45. Knob 54 is threaded onto locking mechanism 52 which enables the movement of locking mechanism 52 to engage guide 45 to hold frame 44 in a desired position. Rotation of knob 54 releases or tightens locking mechanism 52.

Figure 5A:
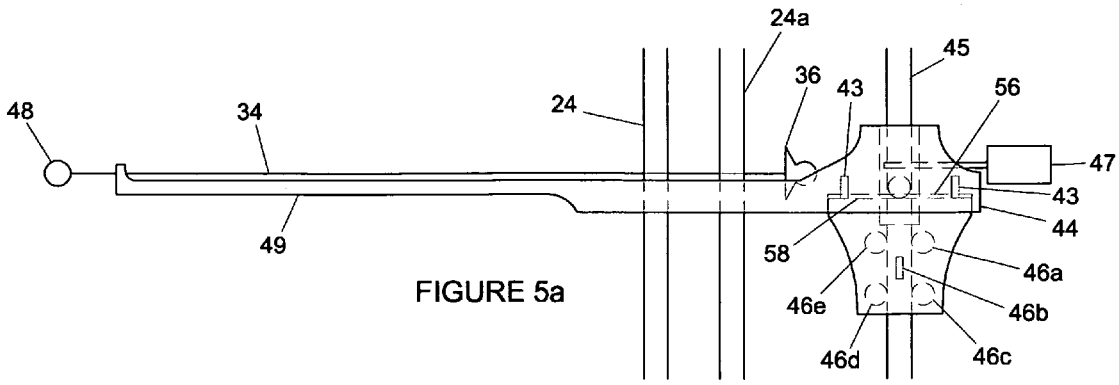
FIG. 5*a* is a side view of a frame and string arrangement of the present invention.
Figure 5B:
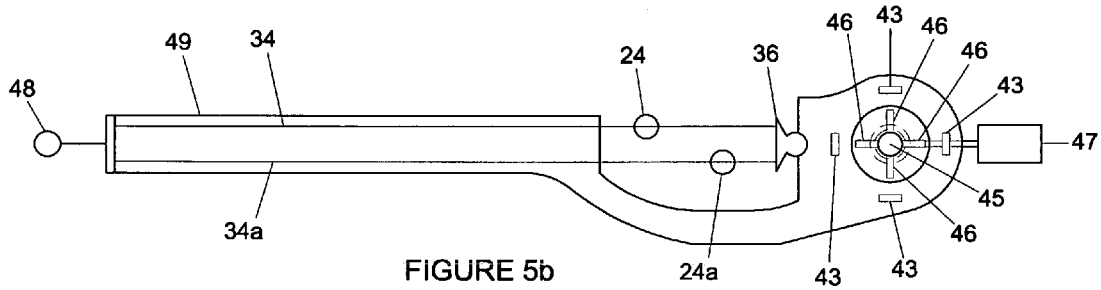
FIG. 5*b* is a top view of an alternative frame and string arrangement of the present invention.
Figure 5C:
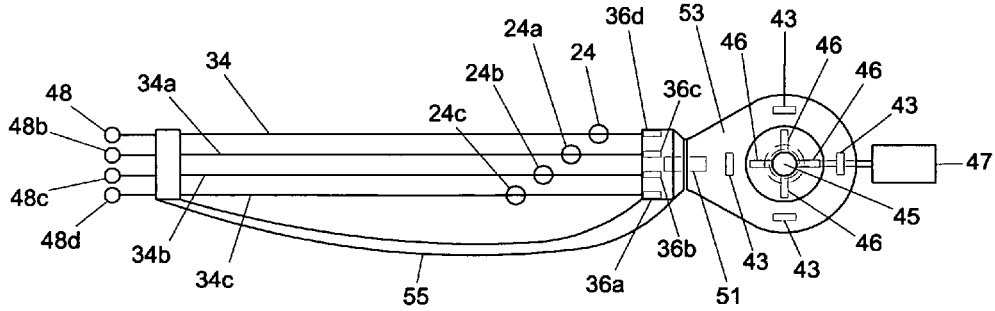
FIG. 5*c* is a top view of another alternative frame and string arrangement of the present invention.

Frame 44 can be arranged as shown in FIGS. 5*a-c*. FIG. 5*a* shows string 34 stretched upon frame 44. Tension in string 34 can be adjusted with tensioner 48, which is tension adjustment element. Various means can be used to adjust tension in string 34 to change the frequency and wavelength of the vibrations emitted by strings 34 upon interaction with stream of water 24. Tensioner 48 can be a screw mounted to the end of frame 44 that winds string 34 tighter or looser as tensioner 48 is turned.

In some aspects, frame 44 has weight 47 positioned on frame 44 to counter balance frame 44 to enable a user to dexterously and precisely move strings 34 within stream of liquid 24. In the other embodiments shown in FIGS. 5*b* and *c*, weight 47 functions in a similar way. FIG. 5*a* demonstrates alternative positioning of sliders 46, designated as 46-46*d*, in frame 44.

In FIG. 5*a*, frame 44 demonstrates the utilization of fretboard or fingerboard 49 to provide further ability of the user to manipulate the frequency and wavelength of the vibrations emanating from string 34, by changing the length of strings 34. Pressing string 34 against fretboard 49 with fingers or another instrument alters and manipulates the vibrations emitted from string 34. The location that strings 34 are pressed against fretboard 49 will determine the resultant length of strings 34 and the frequency of the vibration and sound. FIG. 5*b* has a similar fretboard 49 that enables the manipulation of strings 34 and 34*a*. FIG. 5*c* does not show a fretboard, but it too can have a fretboard to manipulate strings 34, 34*a*, 34*b* and 34*c*.

Referring now to FIGS. 5*a-c*, in particular rotators 43 positioned between frame top 56 and frame bottom 58. Rotators 43 enable frame top 56 to rotate freely upon frame bottom 58 about guide 45. Rotators 43 can be various friction relieving mechanisms including, but not limited to ball bearings, wheels and other equivalent devices. Rotators enable strings 34 and fretboard 49 to be rotated into and out of stream of liquid 24. The number and positioning of rotators 43 is variable. Preferably, four rotators 43 are evenly placed between frame top 56 and frame bottom 58 as demonstrated in the dashed lines for rotators 43 in FIGS. 5*a-c*.

FIGS. 5*b* and 5*c* exhibit the adaptability of the frame 44 and string 34 arrangement of the present invention. FIG. 5*b* demonstrates frame 44 with two strings, string 34 and 34*a* having a single tensioner 48. FIG. 5*c* shows multiple tensioners 48, designated as tensioners 48*a*, 48*b*, 48*c* and 48*d*, assigned to multiple strings 34. These tensioners function similarly to tensioner 48, in that adjusting the position of tensioner 48, such as by turning, pulling or pushing the tensioner will increase or decrease the tension in strings 34. Each string 34 is therefore adjustable to a unique tension to impart different vibration frequencies and wavelengths.

Utilizing multiple strings 34 in FIG. 5*c*, where each string is designated as FIGS. 34, 34*a*, 34*b* and 34*c*, the range of sounds producible by instrument 10 is increased. Although FIGS. 5*b* and 5*c* demonstrates two and four stringed versions, respectively, it should be understood that more strings are considered encompassed by the present invention. It is contemplated that the present invention can be incorporated into a keyboard style instrument wherein numerous strings are contained within a frame. The tension in each string in such an embodiment can also be adjusted separately by either touching keys that increase tension in the strings, or by having individual tensioners 48 that are manipulated to adjust string tension.

FIG. 5*c* shows multiple pickups 36 assigned to each string 34. Therefore, the separate output from each string 34, 34*a*, 34*b* and 34*c* is registered or captured separately. This allows for separate processing and amplification for each string 34. In other multiple string embodiments, a single pickup 36 is used to register vibrations or sounds from all strings 34.

FIG. 5*c* shows pivoter 51 located between body 53 and arm 55. Pivoter enables arm 55 to rotate about the axis center of pivoter 51 as body 53 remains fixed. In the embodiment shown, body 53 is slidingly engaged with guide 45, and therefore is unable to rotate on an axis perpendicular to stream of liquid 24. Pivoter 51 enables rotation in a free manner to allow strings 34 to be positioned at different angles relative to streams of liquid 24-24*c*, or to be rotated out of contact with streams of liquid 24.

FIG. 6 shows user 60 holding frame 44 with string 34 positioned within stream of liquid 24 to produce vibrations or sounds cause by the interactions between stream of liquid 24 and string 34. User 60 is shown moving frame 44 from position 64 to position 62 to generate vibrations and sounds of different frequencies and/or wavelengths. The dashed lines in this instance (dash lines in the rest of the description note internal structures) denote the movement of frame 44 from previous position 64 (in dashed lines) to current position 62. The positions that frame 44 and string 34 can be moved along stream of liquid 24 are many. This includes angling frame 44 relative to stream of liquid 24 to impart different vibrations and sounds. It should be noted that user 60 is shown manually positioning frame 44 and string 34 within stream of liquid 24, but a guide, similar to guide 45 can be used to assist users in positioning frame 44 and string 34. Alternatively, frame 44 and string 34 can be mechanically positioned within stream of liquid 24 by a mechanism that moves frame along a guide.

Figure 7:
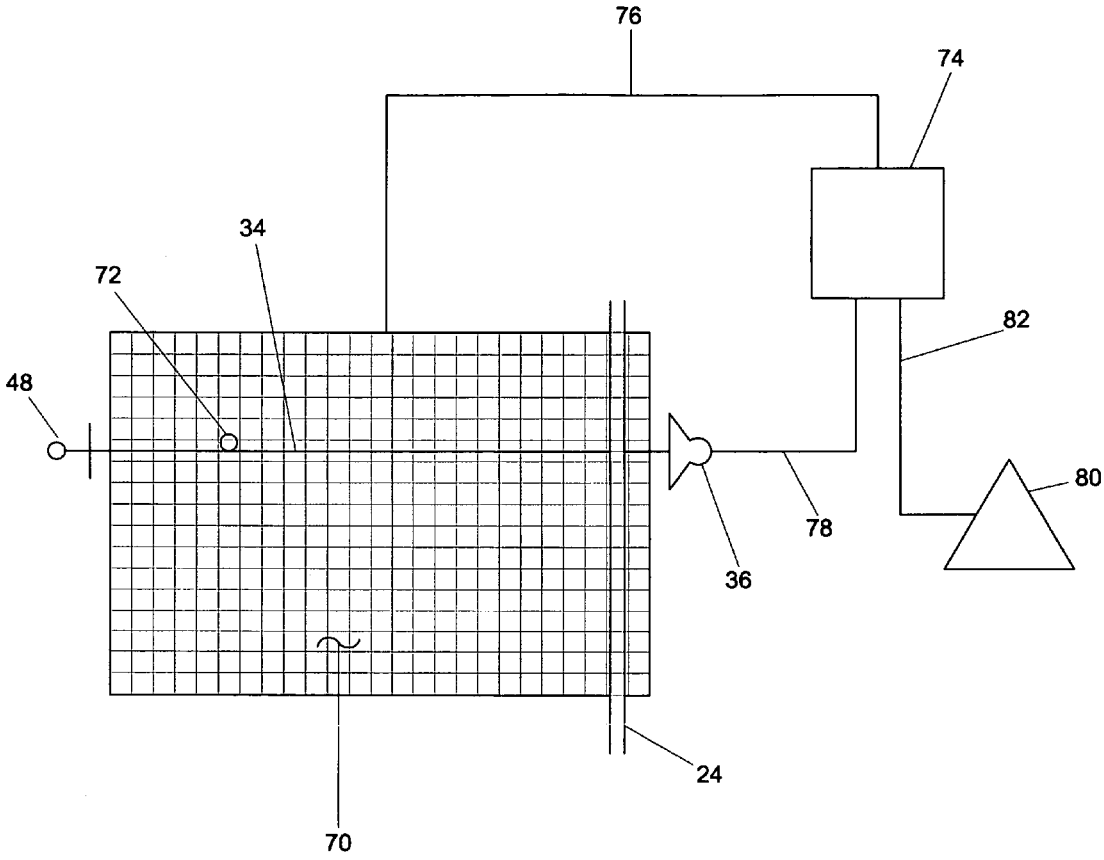
FIG. 7 is schematic diagram of a grid designed to assist a user of the present invention.

FIG. 7 shows grid 70 that can be used to determine positioning of string 34 relative to stream of liquid 24. Positioning device 72 placed proximate string 34 on a frame (see FIGS. 5*a*-*c*) that holds string 34 enables communication with grid 70 to determine positioning of string 34. This positioning system will enable a user to know where to place string 34 in stream of liquid 24, and how long to hold the string in that position, in order to play specific notes in an arrangement. Vibrations and sounds registered by pickup 36 are relayed by transmission line 78 to processor 74. Transmission line 76 relays information from digital grid 70 and positioning device 72 to processor 74. Programming in processor 74 relates frequency of transmission from pickup 36 with x and y coordinates of string 34 on grid 70. Output of the programming in processor 74 can be displayed on monitor 80. An electronic representation of the positioning of string 34, as a user moves string 34 up and down the stream of liquid 24 and changes the length of strings 34 by pressing them against a fretboard, thus is displayed on monitor 80.

Grid 70 is shown as a digital grid that utilizes electronic communication to determine positioning of string 34. Alternatively, grid 70 can be a grid positioned adjacent string 34 that uses a grid pattern ruled into small squares of equal size. Each position on this manual grid 70 coordinates with a frequency emitted by the interaction between said at least one string and said stream of liquid. Notes can be marked on grid 70 to enable a user to know the location on must place string 34 to play a specific note.

Instrument 10 enables a user to control the sounds produced by supplying the moveable or displaceable frame 44 and string 34. The interaction between string 34 and stream of liquid 24 is completely controlled by the user, whether that is due to manual movement by a user that is unrestricted by a guide, or whether guide 45 is used. Valves 26 and 27, and pump 12 enable the user to control the flow rate of the liquid 24 that exits conduit 22 and thus provides further control over the sounds produced. Fretboard 49 and other elements that enable the manipulation of strings 34 enable the production of controlled, reproducible notes as opposed to the random noises.

Although preferred embodiments have been depicted and described in detail herein, it will be apparent to those skilled in the relevant art that various modifications, additions, substitutions and the like can be made without departing from the spirit of the invention and these are therefore considered within the scope of the invention as defined in the claims which follow.

What is claimed:

1. A stringed instrument comprising:

a circulating element to transmit a stream of liquid through a conduit;

at least one string displaceable along said stream of liquid, wherein interaction between said stream of liquid and said at least one string produces vibrations;

a device positioned proximate said at least one string to register said vibrations;

a frame, wherein said at least one string is mounted to said frame and said frame is displaceable along said stream of liquid; and a fretboard on said frame.

2. The stringed instrument of claim 1, wherein said conduit and circulating element are arranged in a loop to circulate liquid.

3. The stringed instrument of claim 2, further comprising at least one receptacle positioned between said conduit and said at least one string.

4. The stringed instrument of claim 2, wherein said circulating element is a positive displacement pump.

5. The stringed instrument of claim 2, wherein said circulating element is a rotodynamic pump.

6. The stringed instrument of claim 1, wherein said stream of liquid is flowing at a constant rate.

7. The stringed instrument of claim 1, further comprising a valve, wherein said valve is used to control said stream of liquid.

8. The stringed instrument of claim 1, wherein interaction between said stream of liquid and said at least one string generate vibrations with frequencies ranging from 220 Hz to 1318 Hz.

9. The stringed instrument of claim 1, further comprising a guide that said frame is slidingly engaged, wherein said guide positions said frame proximate said stream of liquid.

10. The stringed instrument of claim 9, wherein said guide is rotatably engaged with said frame.

11. The stringed instrument of claim 1, further comprising an amplifier, wherein said amplifier increases the amplitude of said vibrations.

12. The stringed instrument of claim 1, further comprising a guide, wherein said frame is rotatably and slidingly engaged with said guide and said guide positions said frame proximate said stream of liquid.

13. The stringed instrument of claim 1, wherein said stream of liquid has a flow rate of 0.92 meters per second to 1.58 meters per second.

14. A stringed instrument comprising:

a circulating element to transmit a stream of liquid through a conduit, wherein said stream of liquid is flowing at a constant rate;

at least one string displaceable along said stream of liquid, wherein interaction between said stream of liquid and said at least one string produces vibrations;

a device positioned proximate said at least one string to register said vibrations; and a grid positioned adjacent said at least one string, wherein said grid is ruled into small squares of equal size and each position on said grid coordinates with a single frequency emitted upon interaction between said at least one string and said stream of liquid.

15. A stringed instrument comprising:

a circulating element to transmit a stream of liquid through a conduit;

at least one string displaceable along said stream of liquid, wherein interaction between said stream of liquid and said at least one string produces vibrations;

a device positioned proximate said at least one string to register said vibrations;

a frame, wherein said at least one string is mounted to said frame and said frame is displaceable along said stream of liquid; and a tension adjustment element on said frame, wherein said tension adjustment element enables said at least one string to be tightened and loosened.

16. The stringed instrument of claim 15, further comprising a frame, wherein said at least one string is mounted to said frame and said frame is displaceable along said stream of liquid.

17. The stringed instrument of claim 16, further comprising a fretboard on said frame.

18. The stringed instrument of claim 15, further comprising a receptacle connected to said circulating element, wherein said receptacle, circulating element and conduit form a loop to collect and circulate liquid toward said at least one string.

19. The stringed instrument of claim 15, wherein said circulating element is a positive displacement pump.

* * * * *